US005495259A

United States Patent [19]

Lyasko

[11] Patent Number: 5,495,259

[45] Date of Patent: Feb. 27, 1996

[54] COMPACT PARAMETRIC ANTENNA

[76] Inventor: Gennady Lyasko, 47/27 Sheshet H'Yamim Street, Netanya, Israel, 42296

[21] Appl. No.: 220,719

[22] Filed: Mar. 31, 1994

[51] Int. Cl.[6] ..... H01Q 1/08

[52] U.S. Cl. ..... 343/788; 343/787

[58] Field of Search ..... 343/788, 787, 343/741, 742, 866, 867, 860, 850, 856; H01Q 1/00, 1/08

[56] References Cited

U.S. PATENT DOCUMENTS

| | | | |
|---|---|---|---|
| 1,523,798 | 1/1925 | Benson et al. | 343/788 |
| 3,300,749 | 1/1967 | Lombardi et al. | 343/895 |
| 4,101,899 | 7/1978 | Jones, Jr. et al. | 343/788 |

FOREIGN PATENT DOCUMENTS

| | | | |
|---|---|---|---|
| 1046697 | 12/1959 | Germany | 343/788 |
| 1138121 | 10/1962 | Germany | 343/788 |
| 58-15302 | 1/1983 | Japan | 343/788 |

OTHER PUBLICATIONS

Walker et al, "Superconducting Superdirectional Antenna Arrays", IEEE Transactions on Antennas and Propagation, vol. AP–25, No. 6, Nov. 1977, pp. 885–887.

*Primary Examiner*—Donald T. Hajec
*Assistant Examiner*—Hoanganh Le
*Attorney, Agent, or Firm*—Mark M. Friedman

[57] ABSTRACT

A compact parametric antenna (CPA) employs the principle of stimulating an electric field E and a magnetic field H for synthesis of an electromagnetic wavefront according to the Poynting vector theory S=E ×H. The CPA includes a dielectric, magnetically-active, open circuit mass core, ampere windings around the mass core and an RF source for driving the windings to produce an electromagnetic wavefront. The principle behind the synthesis of a electromagnetic wavefront is that the RF current source provides a sinusoidal RF current $I_0$ which drives the ampere windings to stimulate an external electric field E and, through the induction of gyromagnetic, gyroscopic and Faraday effects in the dielectric, magnetically-active, open circuit mass core, an external magnetic field H having an internal magnetic flux density B. The configurations and dimensions of CPAs can be readily engineered such that CPAs can replace the many different types of conventional antennas presently utilized in a wide range of communication applications including tactical and global radio communication, television broadcasts, cellular telephone networks, computer WANs and the like.

21 Claims, 5 Drawing Sheets

COMPACT PARAMETRIC ANTENNA

Field and Background of the Invention

The present invention relates to antennas in general and in particular to antennas which employ the principle of stimulating an electric field E and a magnetic field H to synthesize an electromagnetic wavefront according to the Poynting vector theory S=E×H.

Recent progress has been made in the design of antennas as implemented in the crossed field antennas (CFAs) described in U.S. Pat. No. 5,155,495 entitled "Radio Antennas" to M. C. Hately et al. In an CFAs, an electric field E and a magnetic field H are carefully phase synchronized and crossed stressed in space so that they synthesize an electromagnetic wavefront according to the Poynting vector theory S=E ×H.

However, the CFAs suffer from a number of disadvantages. First, they require either two separate feeder systems or a single feeder having a phasing unit for splitting its output to separately stimulate the electric and magnetic fields. Second, they require highly specific physical configurations to achieve the phase matching and cross stressing in space.

Therefore, there is a widely recognized need for antennas which employ the principle of stimulating E and H fields to synthesize electromagnetic wavefronts according to the Poynting vector theory S=E ×H which do not suffer from the above disadvantages.

It would be highly desirable that the antennas can be readily engineered for between 3 KHz to 3 GHz frequency transmissions at power ratings from less than 1 KW to more than 100 KW from about 20° to 360° (isotropic or omni-directional) radiation patterns for use in a wide range of communication applications.

It would still further be highly desirable that the antennas be manufactured from readily available materials, be EMC friendly and not likely to be a danger to users or nearby electronic equipment.

SUMMARY OF THE INVENTION

The main object of the present invention is for antennas which stimulate an electric field E and a magnetic field H for the synthesis of an electromagnetic wavefront according to the Poynting vector theory S=E ×H.

The antennas can be readily engineered for between 3 KHz to 3 GHz frequency transmissions at power ratings from less than 1KW to greater than 100 KW while establishing from about 20° to 360° (isotropic or omni-directional) radiation fields to replace many of the different types of conventional antennas used in a wide range of communication applications.

Hence, according to the present invention, there is provided a compact parametric antenna, comprising: (a) a dielectric, magnetically-active, open circuit mass core; (b) ampere windings around the mass core; and (c) an RF source for driving the windings to produce an electromagnetic wavefront.

The principle behind the synthesis of a electromagnetic wavefront according to the Poynting vector theory S=E×H is that the RF current source provides a sinusoidal RF current $I_0$ which drives the ampere windings to stimulate an external electric field E and, through the induction of gyromagnetic, gyroscopic and Faraday effects in dielectric, magnetically-active, open circuit mass core, an external magnetic field H having an internal magnetic flux density B.

In effect, the compact parametric antenna (CPA) includes a RF source in the form of a RF generator U(F) coupled to a broadband, 50Ω impedance, RF power input step down transformer (TR1) which drives a broadband current output radiation transformer (TR2) in the form of the ampere windings around the mass core. The CPA preferably includes a matching capacitor for matching the 50 Ω impedance of transformer (TR1) to a particular transmission frequency and a resonance capacitor for achieving resonance of the transformer (TR2).

The CPA can further including a transformer (TR3) for adjusting the impedance vector of the CPA and a transformer (TR4) for tuning the linear working range of the mass core. Pair of transformers (TR3) and (TR4) can also be implemented for coupling the current impedance of the CPA to transformer (TR1), tuning of frequency range, magnetic amplifier for high gain, parametric amplifier for very high gain and modulation of magnetic flux density B.

According to features of the present invention, the dielectric, magnetically-active, open circuit mass core displays particular characteristics including a typical magnetic volume mass $M_\epsilon$of at least about 0.01 $m^3$, a capacitive electric permittivity $\epsilon$ from about 2 to about 80, a minimum inductive magnetic permeability $\mu_1$ from about 5 to about 10,000 and a maximum inductive magnetic permeability $\mu_m$ from about 10 to about 30,000.

Furthermore, the mass core can be prepared from a number of different materials including magnetic liquids or solid material from either a single continuous substrate, laminations of punchings, or powdered particles sintered together or otherwise held together by electromagnetic field conducting matrix material. The magnetic liquids or solid materials can be either linear or non-linear magnetic properties.

Still further, the mass cores can be configured as having generally cylindrical shapes, dumbbell shapes or fork-like shapes having one or more loops. The cross-section of the mass cores can be circular, square, rectangular or polygon shaped. The mass cores can also be fabricated as an inner cylindrical portion and an outer tubular-like portion made from two different magnetic materials.

According to further features of the present invention, the ampere windings display particular characteristics including that they extend from the mass core's center along from about 0.5 to about 0.9 of its length at a constant turnings/m per unit length while presenting an angle in the range of 2° –45° with respect to its axis. The windings are preferably manufactured from conductive or superconductive materials including, but not limited to, gold, silver, copper, etc.

Furthermore, the windings can be provided in the form of wires or tapes or can be applied in a liquid spray form which is then hardened either on the outer surface of mass core or in channels prepared therein. Furthermore, the windings can be wound in either a clockwise or counterclockwise fashion, in either a single layer or a multi-layer manner and as either simplex, duplex or triplex windings. Overall, the copper factor, the end factor, the edge factor, the fill factor, the Q factor, the skin effect, etc. of the ampere windings influence the working range and dimensions of the antenna.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of a compact parametric antenna, hereinafter referred to as "CPA", which employs the principle of stimulating an electric field E and a magnetic field H for synthesis of a electromagnetic wavefront according to the Poynting vector theory S=E ×H.

The CPAs can be implemented to replace the many different types of conventional antennas presently utilized in a wide range of communication applications including tactical and global radio communication, television broadcasts, cellular telephone networks and computer WANs, and the like. Hence, the CPAs can be constructed for 3 KHz to 3 GHz frequency transmissions at power ratings from less than 1 KW to greater than 100 KW.

The principles and operation of the CPA of the present invention may be better understood with reference to the drawings and the accompanying description.

Figure 1A:
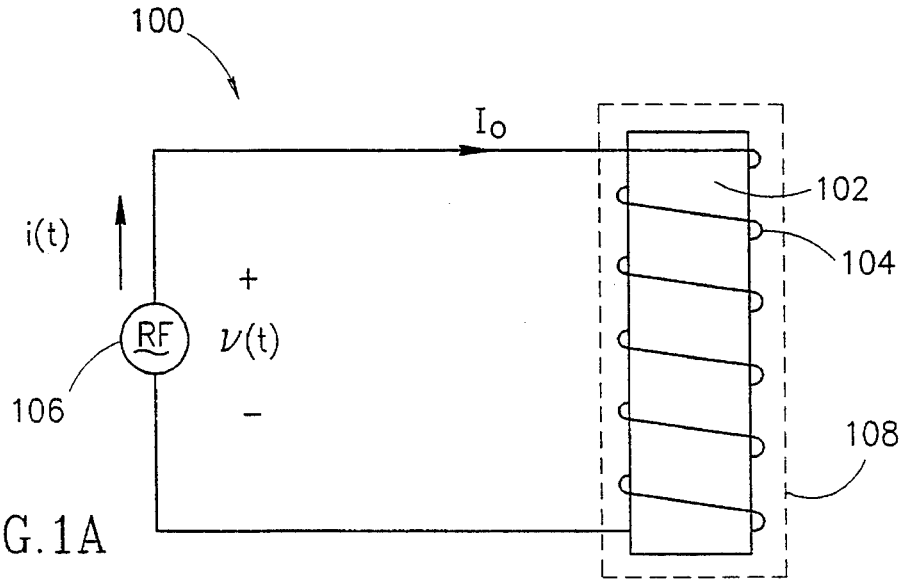
FIG. 1*a* shows a schematic illustration of a compact parametric antenna (CPA) constructed and operative according to the present invention.

Referring now to the drawings, FIG. 1*a* illustrates a schematic illustration of a CPA, constructed and operative according to the teachings of the present invention, generally designated 100, including a dielectric, magnetically-active, open circuit mass core 102, ampere windings 104 around mass core 102 and a RF source 106 for driving windings 104. Mass core 102 and windings 104 are preferably housed in an electromagnetic field permeable housing 108, for example, fabricated from fiberglass composite material.

Figure 1B:
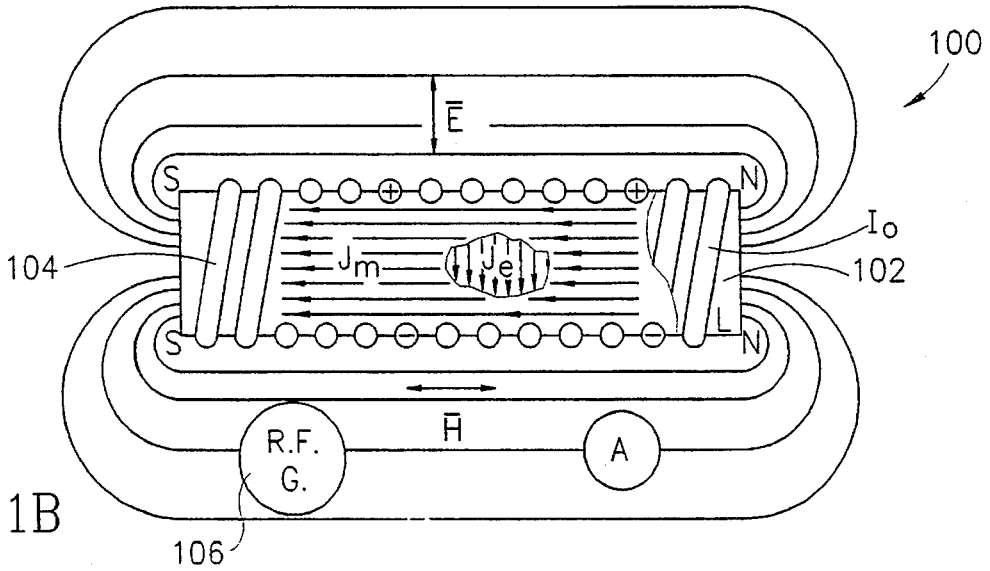
FIG. 1*b* shows both the internal and external electric and magnetic fields of the CPA.

The principle behind the synthesis of a electromagnetic wavefront according to the Poynting vector theory S=E×H is that RF current source 106 provides a sinusoidal RF current $I_0$ which drives ampere windings 104 to stimulate an external electric field E and, through the induction of gyromagnetic, gyroscopic and Faraday effects in dielectric, magnetically-active, open circuit mass core 102, an external magnetic field H having an internal magnetic flux density B as will now be described with reference to FIG. 1*b*.

Sinusoidal RF current $I_0$ flowing through ampere windings 104 produces an external axial electric field E and an internal uniform electric field $E_0$ having an electric flux density $D_0$. Both electric fields E and $E_0$ have vectors perpendicular to the axis of mass core 102 according to Coulomb forces between electric charges. Electric field $E_0$ generates both an electrical displacement current $J_e$ of electric charges in mass core 102 according to the Faraday effect and a magnetic displacement current $J_m$ of magnetic charges in mass core 102 according to Lorentz forces between electrical and magnetic fields. Due to the open circuit configuration of mass core 102, magnetic displacement current $J_m$ induces an external axial magnetic field H having a magnetic flux density B co-axial to mass core 102 according to Maxwell's and Dirac's equations.

Figure 1C:
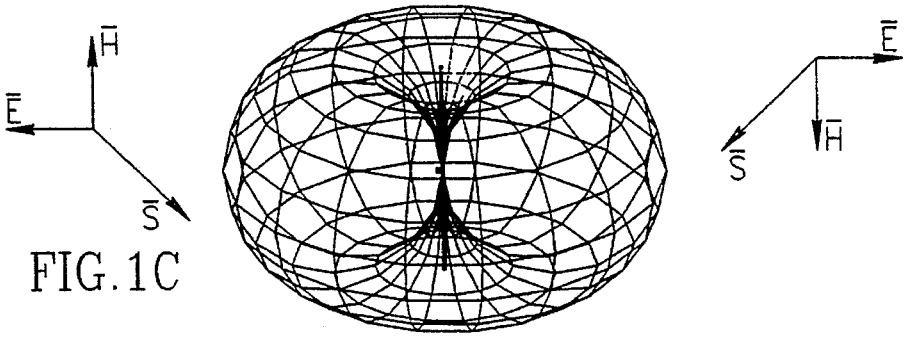
FIG. 1*c* shows the resultant radiation pattern of the CPA.

Hence, it can be appreciated that CPA 100 acts as both electric and magnetic dipoles to generate external RF dipole-like electric and magnetic fields, E and H, respectively, for propagation of electric and magnetic polarization charges. The electric and magnetic fields E and H are crossed so that they synthesize an omni-directional or isotropic electromagnetic wavefront denoted S shown in FIG. 1*c* according to the Poynting vector theory S=E×H.

The electrical diagrams for a particular implementation of CPA 100 for 3–30 MHz frequency transmissions for tactical and global communication applications are now described with reference to FIG. 2*a*–2*d*.

Figure 2A:
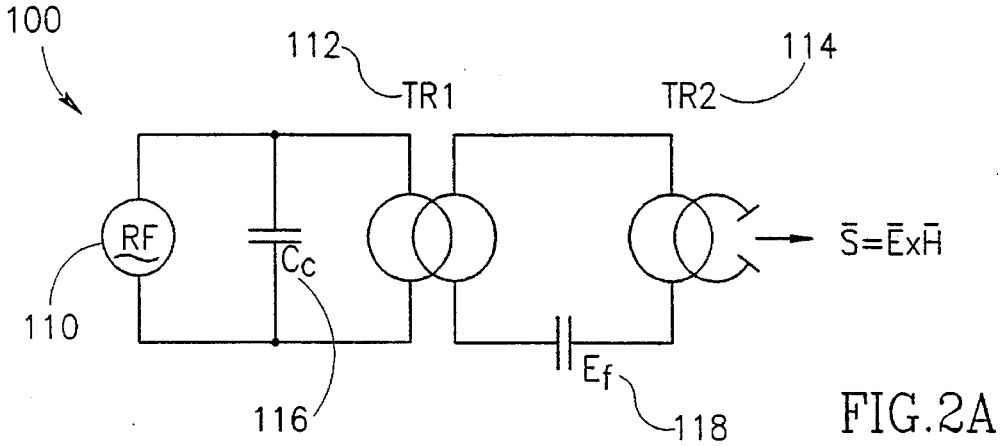
FIGS. 2*a*–2*d* show the principle and equivalent electrical diagrams of the CPA.

FIG. 2*a* shows the principle electrical diagram of CPA 100 wherein RF source 106 is shown as a RF generator U(F) 110 coupled to a 3–30 MHz broadband, 50Ω impedance, RF power input step down transformer (TR1) 112 for driving a 3–30 MHz broadband current output radiation transformer (TR2) 114 in the form of ampere windings 104 around mass core 102. CPA 100 preferably includes a matching capacitor $C_c$ 116 typically having a 5–50 pF capacitance for matching the 50 Ω impedance of transformer (TR1) 112 to a particular transmission frequency and a resonance capacitor $C_f$ 118 typically having a 5–500 pF capacitance for achieving resonance of transformer (TR2) 114.

Figure 2B:
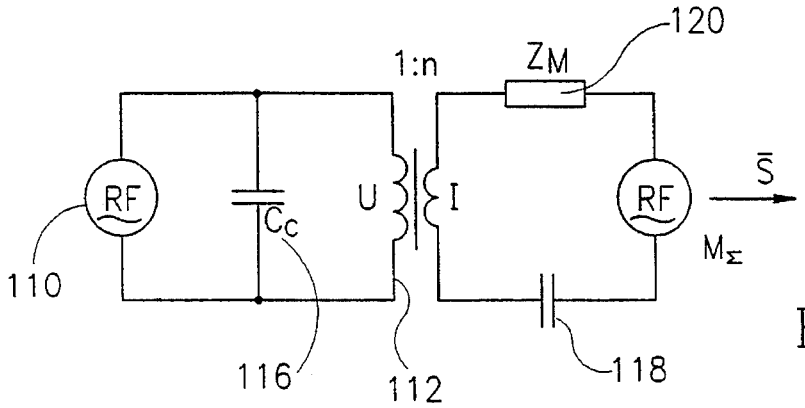

FIG. 2*b* shows the equivalent electrical diagram of FIG. 2*a* in which the magnetic and electrical characteristics of transformer (TR2) 114 or, in other words, mass core 102 and ampere windings 104 are depicted as impedance $Z_m$ 120. Transformer (TR2) 114 typically has an impedance $Z_m$ in the range of 12–30 Ω which can be matched by adjustment of capacitor $C_c$ 116 to achieve the maximum transfer of RF power from transformer (TR1) 112. Transformer (TR2) 114 typically provides current in the range of 0.5–100 A depending on the power rating of CPA 100.

Figure 2C:
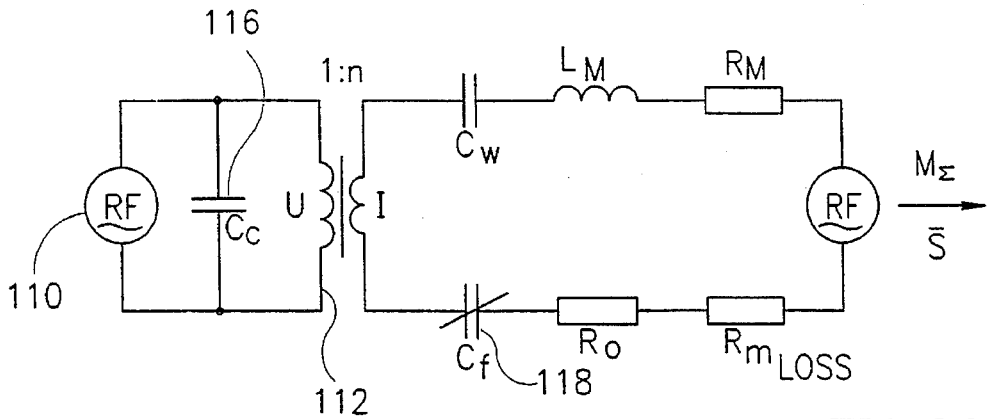

FIG. 2*c* shows the equivalent electrical diagram of CPA 100 wherein antenna impedance $Z_m$ 120 of transformer (TR2) 114 is depicted as a plurality of electrical and magnetic characteristics of mass core 102 and windings 104. Hence, impedance $Z_m$ 120 includes the volume mass of magnetic core $M_\epsilon$, the core reactance $R_{loss}$ and the core reactance $R_m$ of mass core 102 and the coil resistance $R_o$, the coil capacitance $C_w$ and the coil inductance $L_\mu$of ampere windings 104.

Figure 2D:
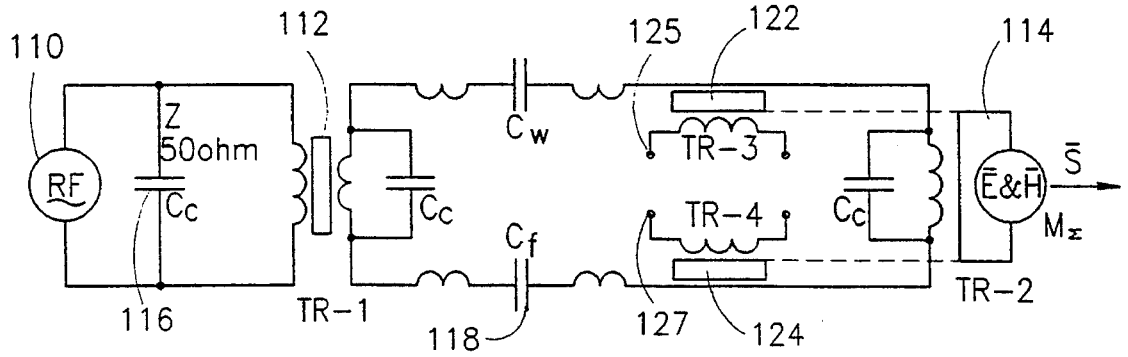

FIG. 2*d* shows the equivalent electrical diagram of an upgraded CPA 100 further including a transformer (TR3) 122 for adjusting the impedance vector of CPA 100 and a transformer (TR4) 124 for tuning the linear working range of mass core 102. Pair of transformers (TR3) and (TR4) 122 and 124 can also be implemented for coupling the current impedance of CPA 100 to transformer (TR1) 112, tuning of frequency range, utilizing mass core 102 as a magnetic amplifier for high gain, utilizing mass core 102 as a parametric amplifier for very high gain and modulation of magnetic flux density B. It is known that modifying the magnetic flux density B or inductivity permeability tx of mass core 102 enables adjustment of transmission gain, voltage gain, current gain, power gain, frequency gain and the value of the coil inductance of non-linear elements. When transformers (TR3) and (TR4) 122 and 124 are used for tuning or parametric amplification, then two additional power sources 125 and 127 are required in which power source 125 is a DC source $U_0$ while source 127 is an RF source U(2F). However, for amplitude modulation, source 127 provides a variable current.

It is a particular feature of the present invention that the configuration, dimensions and fabrication of mass core 102 and windings 104 of CPA 100 can be engineered to achieve the broadband transmission, the frequency range, the electrical height, the power rating, the gain, the impedance, the angle of radiation field, the polarization, etc. of the many different types of conventional antennas used for a wide range of applications.

One of the particular advantages of CPAs is that they have a Short Factor of from about 100 to about 400 which is considerably smaller than the Short Factor of 2 of conventional antennas such that a CPA can now have approximate dimensions of 0.5–1.0 m, rather than tens of meters as required by conventional antenna theory, for 3–30 MHz frequency transmissions. A further advantage rendered by the novel CPA design is that 3–30 MHz frequency transmissions can be achieved without the need for mounting on a tall structure.

The particular characteristics of dielectric, magnetically-active, open circuit mass core 102 for operation at between 3 KHz–3 GHz frequency transmissions at power ratings from less than 1 KW to more than 100 KW include a typical magnetic volume mass $M_\epsilon$ of at least about 0.01 $m^3$, a capacitive electric permittivity $\epsilon$ from about 2 to about 80, a minimum inductive magnetic permeability $\mu_1$ from about 5 to about 10,000 and a maximum inductive magnetic permeability $\mu_m$ from about 10 to about 60,000. These characteristics can be achieved by management of the magnetic volume mass, the loss factor, the core factor, the $\mu$ factor, the Q factor, etc. of mass core 102 as known in the art.

Mass core 102 can be fabricated from any suitable electromagnetic field supporting material including magnetic liquids or solid materials in the form of a single continuous substrate, laminations of punchings, or powdered particles sintered together or otherwise held together by electromagnetic field conducting matrix material. Mass core 102 can be fabricated from either linear or non-linear material for implementing mass core 102 as a magnetic amplifier, as a parametric amplifier or, using magnetic liquid, as a molecular amplifier.

For magnetic liquid mass cores 102, the dielectric magnetic liquid is preferably of the ML new class characterized by having parameters: permittivity E from about 2 to about 80, a permeability $\mu_1$ from about 5 to about 10,000 and a permeability $\mu_m$, from about 10 to about 30,000 and particles from about 2 to about 100 μm for 3 Hz to 3 GHz frequency transmissions.

For single continuous substrate mass cores 102, the substrate is preferably of the soft magnetic class characterized by having parameters: permittivity $\epsilon$ from about 2 to about 10, a permeability $\mu_1$ from about 5 to about 10,000, a permeability $\mu_m$ from about 10 to about 30,000 and particles in the range of 2–100 μm. For mass cores 102 made from laminations of punchings or powdered particles, the punchings and particles are preferably of supermallay class materials. Furthermore, art developed in a wide range of technologies and transformer technology in particular can be beneficially applied to mass cores 102.

For approximately 3–30 KHz frequency transmissions, mass cores 102 typically have a permittivity $\epsilon$ from about 2 to about 10, a permeability $\mu_1$ from about 4,000 to about 10,000 and a permeability $\mu_m$ from about 10,000 to about 30,000. While for 3–10 MHz frequency transmissions, mass cores 102 typically have a permittivity $\epsilon$ from about 5 to about 20, a permeability $\mu_1$ from about 50 to about 200 and a permeability $\mu_m$ from about 400 to about 800.

With reference now to FIGS. 3*a*–3*d*, four configurations of mass core 102 are shown enabling a measure of control over electric and magnetic fields E and H, respectively, for different frequency transmissions, power ratings, and wavefront direction requirements.

Figure 3A:
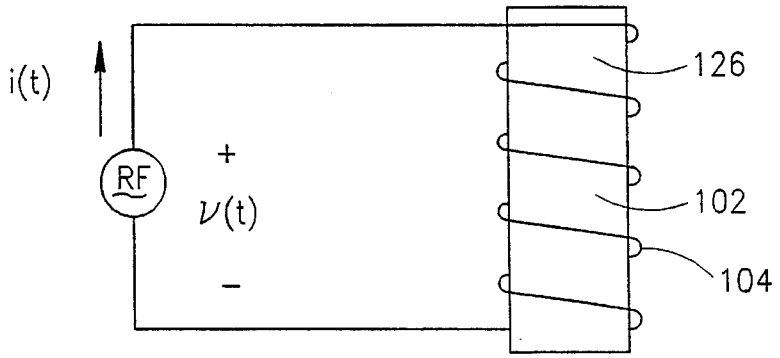
FIGS. 3*a*–3*d* show four configurations of the mass core of the CPA.
Figure 3B:
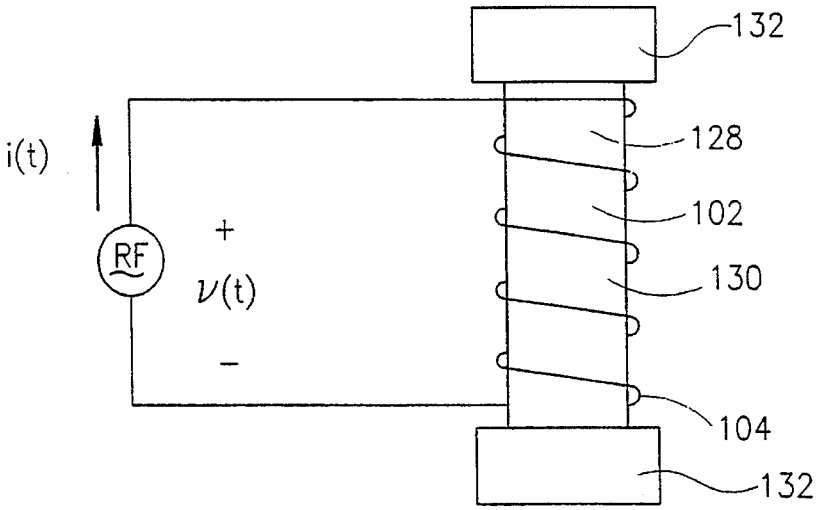

FIGS. 3*a* and 3*b* show mass cores 102 which are preferably made from linear magnetic materials for conventional gains. In particular, FIG. 3*a* shows mass core 102 having a basic cylindrical shape 126 while FIG. 3*b* shows mass core 102 having dumbbell shape 128. Dumbbell shape 128 has a neck portion 130 of at least 50% of the length of mass core 102 terminated with end portions 132. It a particular feature of dumbbell shaped mass cores 128 that end portions 130 are preferably made from magnetic materials having greater permeabilities $\mu_1$ and $\mu_m$ than neck portion 130 to increase magnetic flux density B without changing the operating frequency.

Figure 3C:
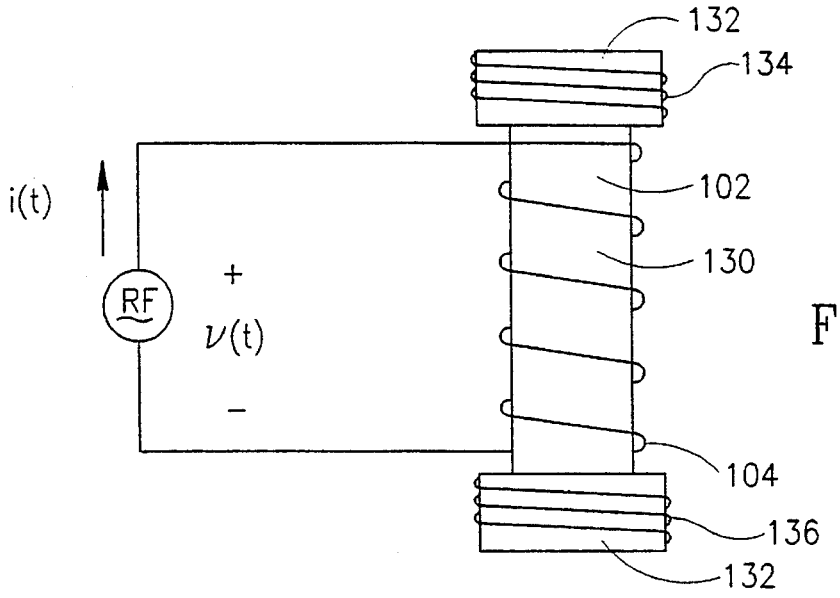
Figure 3D:
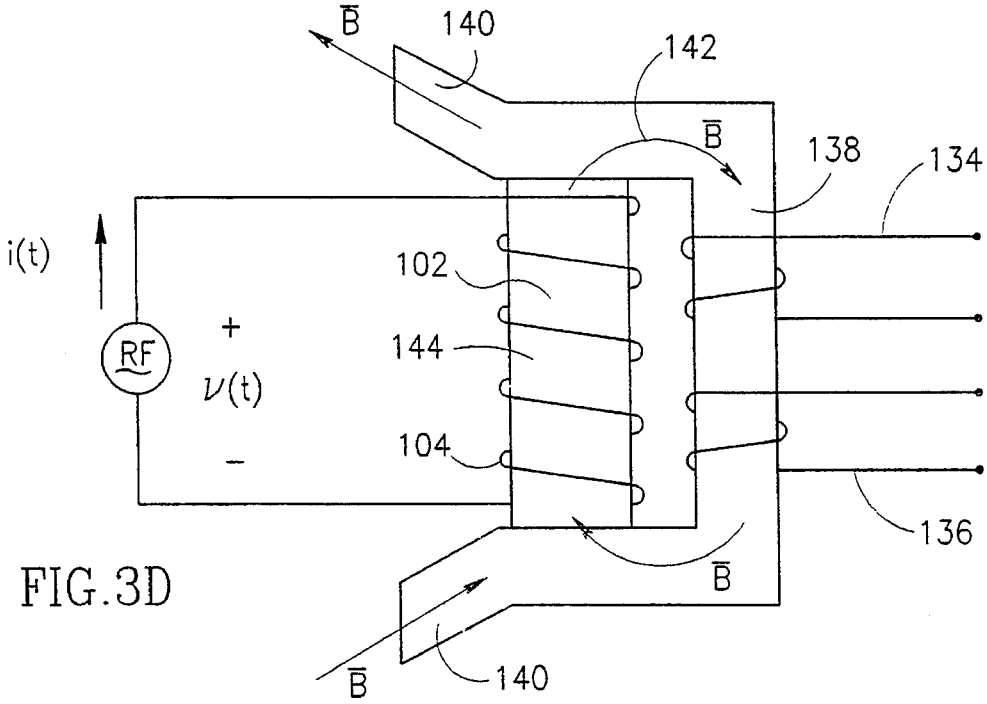

FIGS. 3*c* and 3*d* show mass cores 102 which-are preferably made from non-linear magnetic materials for amplifying magnetic flux density B and/or modulation of electromagnetic wavefront W. For this purpose, end portions 132 of dumbbell shaped mass cores 128 have additional ampere windings 134 and 136 for implementation of transformers (TR3) 122 and (TR4) 124 for adjusting the impedance vector and for tuning the linear working range of CPA 100, respectively.

FIG. 3*d* shows a mass core 102 having a fork-like member 138 having diverging legs 140 and one or more loops 142 made by cross member 144. Loop 142 provides a closed path for the internal electric flux density $D_0$ and magnetic flux density $B_0$ for amplification of the electromagnetic energy. The angle subtended by diverging legs 140 controls the polarization and directivity of the radiation field such that between from about 20° to 360° (isotropic or omnidirectional) radiation fields can be established. Fork-like member 138 and cross member 144 are preferably made from different materials.

Figure 4A:
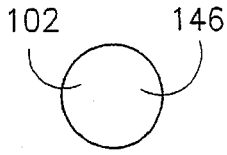
FIGS. 4*a*–4*e* show five differently shaped cross-sections of the mass core of the CPA.
Figure 4B:
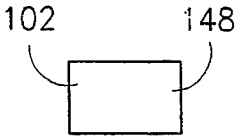
Figure 4C:
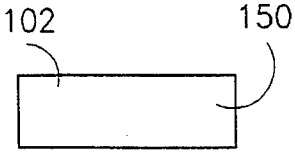
Figure 4D:
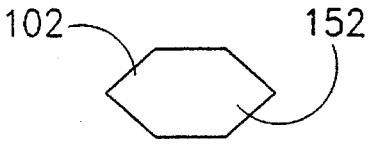
Figure 4E:
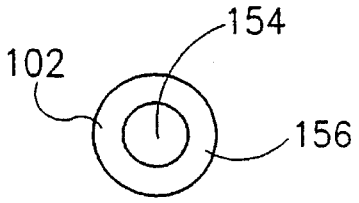

Mass cores 102 preferably have a substantially circular cross-section 146 as shown in FIG. 4*a* to facilitate the generation of axial electric and magnetic fields and a diameter from about 2 to about 25 cm and a length from about 5 to about 300 cm, thereby providing magnetic volume masses $M_\epsilon$of at least about 0.01 $m^3$. However, mass cores 102 can also be configured to have other cross-section shapes as shown in FIGS. 4*b*–4*d*, including a substantially square cross-section 148 (FIG. 4*b*), a substantially rectangular cross-section 150 (FIG. 4*c*), and a substantially polygon shape cross-section 152 (FIG. 4*d*). Mass cores 102 can also be fabricated as an inner cylindrical portion 154 and an outer tubular-like portion 156 made from two different magnetic materials as shown in FIG. 4*e*.

The particular characteristics of ampere windings 104 for 3 KHz–3 GHz frequency transmissions at power ratings from less than 1 KW to greater than 100 KW include that they extend from its center along from about 0.5 to about 0.9 of its length at a constant turnings/m per unit length and that they present an angle from about 2° to about 45° with respect to its axis. Windings 104 are preferably manufactured from conductive or superconductive materials including, but not limited to, gold, silver, copper, etc.

Figure 5A:
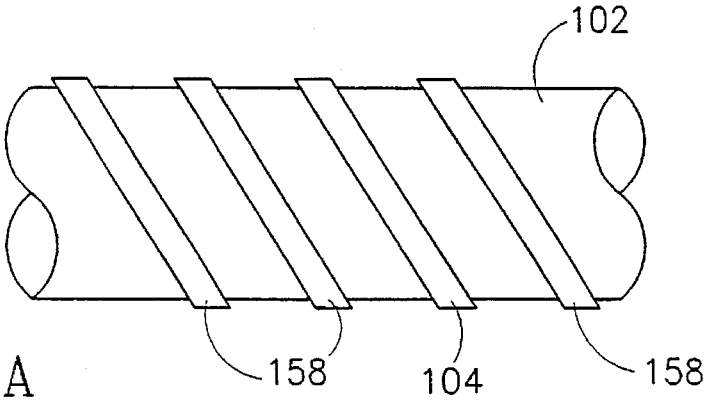
FIGS. 5*a* and 5*b* show two configurations of the ampere windings of the CPA.
Figure 5B:
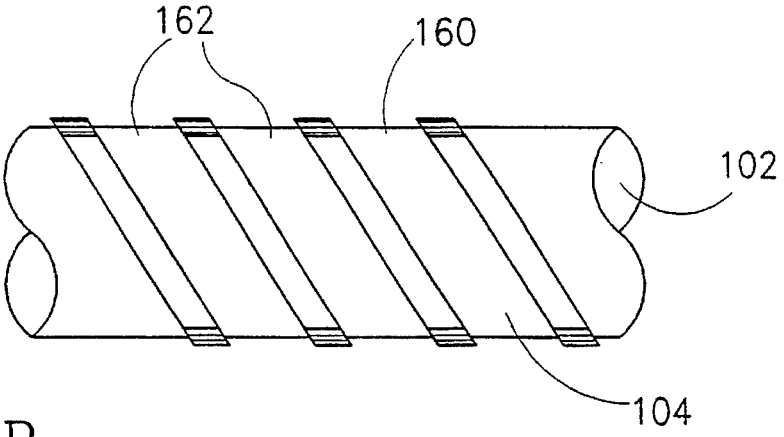

Windings 104 can be provided in the form of wires 158, tapes 160 or can be applied in a liquid spray form which is then hardened either on the outer surface of mass core 102 or in channels 162 as shown in FIGS. 5*a* and 5*b*. Wires 158 can have diameters from about 2 to about 50 mm, tapes 160 can have widths from about 4 to about 50 mm and thicknesses from about 0.1 to about 5 mm while channels 162 can have widths from about 2 to about 50 mm and depths from about 0.1 to about 5 mm.

Furthermore windings 104 can be wound in either a clockwise or counterclockwise fashion, in either a single layer or a multi-layer manner and as either simplex, duplex or triplex windings. In all cases, windings 104 are preferably wound around mass core 102 such that secure physical contact is achieved therebetween to induce stronger field strengths and to facilitate more accurate parametric control over CPA 100. Overall, the copper factor, the end factor, the edge factor, the fill factor, the Q factor, the skin effect, etc. of ampere windings 104 influence the working range and dimensions of CPA 100.

While the invention has been described with respect to a limited number of embodiments, it will be appreciated that many variations, modifications and other applications of the invention may be made.

What is claimed is:

1. A compact parametric antenna, comprising:

(a) a dielectric, magnetically-active, open circuit mass core;

(b) ampere windings around said mass core, said mass core being made of magnetic liquid having a capacitive electric permittivity $\epsilon$ from about 2 to about 80, an initial permeability $\mu_1$ from about 5 to about 10,000 and a particle size from about 2 to about 100 μm; and (c) an RF source for driving said windings to produce an electromagnetic wavefront.

2. The antenna as in claim 1, wherein said mass core has a volume mass of at least about 0.01 $m^3$.

3. The antenna as in claim 1, wherein said mass core is substantially cylindrically shaped.

4. The antenna as in claim 1, wherein said mass core is substantially dumbbell shaped.

5. The antenna as in claim 1, wherein said mass core is substantially fork-like shaped.

6. The antenna as in claim 1, wherein said mass core has a cross-sectional shape selected from the group consisting of circular, square, rectangular and polygon.

7. The antenna as in claim 1, wherein said mass core is fabricated as an inner cylindrical portion and an outer tubular-like portion.

8. The antenna as in claim 1, wherein said windings are made of conductive material.

9. The antennas as in claim 1, wherein said windings are made of superconductive material.

10. The antenna as in claim 1, wherein said windings are made of an element selected from the group consisting of gold, silver and copper.

11. The antenna as in claim 1, wherein said windings have a constant turnings/m value per unit length.

12. The antenna as in claim 1, wherein said windings present an angle of turn in the range of from about 2° to about 45° with respect to the axis of said mass core.

13. The antenna as in claim 1, wherein said windings extend from the center of said mass core along from about 0.5 to about 0.9 of its length.

14. The antenna as in claim 1, wherein said windings are configured as wires having diameters from about 2 to about 50 mm.

15. The antenna as in claim 1, wherein said windings are configured as tapes having widths from about 4 to about 50 mm and thicknesses from about 0.1 to about 5 mm.

16. The antenna as in claim 1, wherein said windings are applied in a liquid spray form.

17. The antenna as in claim 1, wherein said windings are wound on the outer surface of said mass core.

18. The antenna as in claim 1, wherein said windings are wound in channels having widths from about 2 to about 50 mm and depths from about 0.1 to about 5 mm.

19. The antenna as in claim 1, wherein said windings are wound in a clockwise.

20. The antenna as in claim 1, wherein said windings are wound in a counterclockwise fashion.

21. The antenna as in claim 1, wherein said windings are wound in a single layer.

* * * * *